United States Patent [19]

Gergely

[11] 4,216,104

[45] Aug. 5, 1980

[54] PROCESS OF MANUFACTURING A GAS-GENERATING CLEANING MATERIAL

[76] Inventor: Gerhard Gergely, Gartengasse 8, Wien, Austria, 1053

[21] Appl. No.: 857,843

[22] Filed: Dec. 5, 1977

[30] Foreign Application Priority Data

Dec. 3, 1976 [AT] Austria ..... 8978/76

[51] Int. Cl.[2] ..... C11D 11/00; C11D 7/12; B08B 1/00

[52] U.S. Cl. ..... 252/91; 15/104.93; 252/92; 252/95; 252/135; 252/99; 252/188.3 R; 252/531; 252/550; 424/53; 427/209; 427/327; 427/384; 427/395

[58] Field of Search ..... 252/91, 92, 95, 97, 252/135, 99, 531, 188.3 R; 15/104.93, 104.94; 427/384, 395, 209; 424/53

[56] References Cited

U.S. PATENT DOCUMENTS

| | | | |
|---|---|---|---|
| 2,665,528 | 1/1954 | Sternfield et al. | 51/185 |
| 2,733,211 | 1/1956 | Maxcy et al. | 252/91 |
| 3,115,425 | 12/1963 | Zmoda | 134/6 |
| 3,296,144 | 1/1967 | White | 252/91 |
| 3,324,500 | 6/1967 | Fuller et al. | 15/104.93 |
| 3,325,368 | 6/1967 | Wood | 424/16 |
| 3,607,759 | 9/1971 | Barth | 252/100 |
| 3,630,924 | 12/1971 | Miller | 252/100 |
| 3,704,227 | 11/1972 | Hill | 252/95 |
| 3,725,288 | 4/1973 | Bechtold | 252/91 |

*Primary Examiner*—P. E. Willis, Jr.
*Attorney, Agent, or Firm*—Karl W. Flocks

[57] ABSTRACT

A cleaning pad comprises a porous flexible substrate impregnated with detergent, adhesive, a gas-generating compound and a compound to trigger release of gas by the gas-generating compound.

9 Claims, No Drawings

PROCESS OF MANUFACTURING A GAS-GENERATING CLEANING MATERIAL

FIELD OF INVENTION

The present invention relates to a cleaning material, and, more particularly, to a cleaning material consisting of a support for a detergent or other cleaning agent, which support is of paper, fabric, sponge or the like, as well as to a process of manufacturing such cleaning material.

BACKGROUND OF THE INVENTION

There are already known cleaning materials, wherein a support, generally a paper-fiber fleece or non-woven fabric, or a textile fabric, is impregnated with a cleaning agent. Such cleaning materials possess a cleaning effect which does not exceed the cleaning effect normally expected from the cleaning agent. The cleaning agent is normally a detergent or surfactant.

SUMMARY OF THE INVENTION

On the other hand, the cleaning material of the invention contains a novel combination of substances that, on use of the material, produce a cleaning effect which far exceeds the action which would normally be expected. The cleaning material of the invention is characterized in that the detergent support is coated or impregnated with a detergent (surfactant) and an adhesive, at least one substance capable of developing or forming a gas, if required a substance triggering the formation of the gas, as well as further additives normally used with cleaning agents.

DETAILED DESCRIPTION OF THE PREFERRED EMBODIMENT

The support for the cleaning agent may be coated or impregnated with the detergent, the adhesive, the at least one substance capable of forming a gas, the possibly required at least one substance triggering the formation of gas and, possibly, further additives, as a single mixture of components. In accordance with a further preferred embodiment of the invention, the substance(s) capable of forming gas, an adhesive and, possibly, further customary additives, form a first mixture of components; and the substance(s) triggering the formation of gas, an adhesive and further customary additives for a second mixture of components. Such separate mixtures may be contained in separate areas of the support, in which connection the first mixture of components and/or the second mixture of components contains a detergent or the like. The two mixtures of components may in this case be present on the support in the form of adjacent strips, spots or in similar forms. Especially when a sponge is used as support, it is expedient to arrange the two mixtures of components on opposite sides of the sponge to a depth of penetration at which mutual contact of the mixtures is avoided.

It is also possible to arrange the two mixtures of components on two separate supports and join such supports into a unit by means of a separating bonding layer, which may likewise consist of the support material. The bonding layer is provided for this purpose, e.g., with an adhesive that can be activated through the thermal effect, such as polyethylene glycols and their ethers.

Examples of substances capable of forming or developing gas include: calcium hydride, substances generating oxygen and substances generating $CO_2$. As substances generating oxygen, there are preferably used peroxo compounds, such as potassium monopersulfate or sodium perborate. As compounds generating $CO_2$, there are preferably used compounds of alkali and/or alkaline earth metals, such as sodium carbonate, sodium bicarbonate, calcium carbonate, magnesium carbonate and the like.

With the exception of calcium hydride, the substances capable of forming gas require the presence of a substance triggering the formation of gas, which reacts with the substance capable of forming gas in the aqueous medium wherein the cleaning material is used. In the case where the peroxo compounds are used, such substances that trigger the formation of gas consist of alkalis, catalysts, etc. In the case where one uses substances that split off $CO_2$, the substances triggering the formation of gas consist of acids, such as fumaric acid, citric acid, tartaric acid, or substances exhibiting an acid reaction in aqueous solution, e.g., sodium bisulfate.

The detergents may be anionic, cationic or nonionogenic. Sodium lauryl sulfate, sulfonates and the like are suitable as anionic surfactants.

Suitable adhesives include: polyvinyl pyrrolidene, gums, alginates, polyvinyl alcohol and the like. Suitable common additives include: sodium phosphate, disinfectants, dyes, perfume substances and the like. It is very advantageous to add to the detergent substances which improve foaming and mechanical scouring effects. Micronized silicic acid is preferably used for this purpose.

The process of manufacturing the cleaning material of the invention is characterized by forming a solution and/or suspension from the surfactant(s), the adhesive, the at least one gas generating substance and, if required, the at least one substance triggering the formation of gas, and to the extent desired further additives customary for cleaning agents, using water and/or polar and/or nonpolar solvents. The carrier consisting of paper, fabric, sponge or the like is then coated or impregnated with the solution or suspension and the support thus treated is dried.

If all the components of the detergent are to be arranged as a single mixture of components on the support, it is necessary to form a suspension thereof in a nonpolar solvent. The support is then dipped into such suspension or otherwise impregnated therewith, after which the solvent is evaporated.

When the application is effected through two separate mixtures of components, separate solutions or suspensions are formed in water and/or polar and/or nonpolar solvents in which connection one of the mixtures of components contains the gas-generating substance, while the other contains the substance triggering the release of gas. Further, one or both of such mixtures of components contain the detergent(s) and, possibly, further additives customarily used with detergents. The solutions or suspensions thus produced are applied to the support separately in the form of adjacent strips, spots or the like. For example, a sponge may be impregnated on both sides with the solutions or suspensions, in which connection the depth of penetration is selected such that the two mixtures of components do not contact each other.

Further, supports consisting, e.g., of a paper-fiber fleece or non-woven fabric, may in each case be treated with one of the mixtures of components, dried and then joined at the faces to each other so as to form a unit, by means of a joining layer, which may likewise consist of the same support material and which possesses an adhesive layer.

If the detergent is processed in the form of suspensions, it is important that, prior to the preparation of the suspensions, the substances to be suspended, the adhesives and the fillers be ground finely to a particle size lower than 5μ.

The cleaning material of the invention is activated with water. The separate components of the detergent develop their full activity in water and, furthermore, a gas is formed. The formation of gas increases not only the generation of foam, but leads also to an improvement in the scouring or abrasion effect of the foam cells and the abrasive agents which are finely distributed among such cells and present in three phases. Moreover, in the case of oxygen generating substances, an advantageous oxidation effect takes place in many cases, while a reducing effect is obtained when one uses calcium hydride.

The cleaning material of the invention may be used in the form of simple cleaning or scouring pads. Tests have shown that the cleaning material of the invention completely and in the shortest possible time removes the normal dirt from tiles, window panes, washbasins and the like. Moreover, even in the case of persistent silicon dirt, e.g., on windshields, which can normally be removed only by means of special solvents, a brief wiping with a moistened pad is sufficient for completely removing the silicon.

When the cleaning material contains scouring agents, micronized silicic acid and calcium hydride or sodium borohydride as hydrogen-releasing substances, in addition to other customary additives, it acts as an effective metal-cleaning agent, which removes also oxidation-type surface impurities.

A further, particularly advantageous use of the cleaning material of the invention is that of a prosthesis-cleaning agent. The cleaning of artificial dentures, prostheses, dental braces, bridges, etc., has previously required products that were suspended and dissolved in a glass of water together with the prosthesis. Such products were sold in the form of powders, granulates or tablets, preferably also in the form of effervescent tablets. The effect of such products was based on the dissolution of detergent substances together with oxygen-releasing substances, among others also hypochlorites, which removed the deposits from the denture prosthesis and disinfected it at the same time. Although such products possess and have possessed in some cases a very good cleaning effect, they have the disadvantage of requiring at least a glass or a cup, i.e., a washing space, and the dissolving of the product requires a certain time and also the effect of the solution of the denture prosthesis should always last a least a few minutes. The local concentration of the cleaning and disinfecting substances on the denture itself was relatively low, owing to the fact that the required amount of water for cleaning the denture amounted to 150–200 ml. If it is assumed that about 3 g substance were dissolved in 200 ml water, of which 2 g are to be considered as detergents, the cleaning took place practically in a 1% solution. It is obvious that the cleaning in a 1% solution must certainly require some extended time.

Absorbent paper is preferably used as the carrier or support for the cleaning substances. Since the amount of the substances must always be considerable (not less than 2 g), the paper must be densely coated. This can be done without difficulties in accordance with the process of the invention.

If a mixture of, e.g., sodium carbonate, sodium phosphate and polyvinyl pyrrolidone is suspended in methylene chloride methanol and ground in a circulation process on a suitable wet grinder to a size less than 5μ, it is possible to produce concentrations on the paper substrate in which about 50–100 mg can be applied per $cm^2$. A strip of paper in the size of 4×5 cm could thus carry up to 2 g substances, so that such strip corresponds to a commercial tablet in regard to concentration.

On the other hand, the invention is particularly advantageous for the production of effervescent tablets. Thus, if a paper strip is coated with a mixture of, e.g., sodium carbonate, sodium phosphate and PVP as adhesive, and a second paper strip is coated with the acid component of the effervescent mixture, i.e., potassium monopersulfate, citric acid or another organic acid, while again using an adhesive, there results two different separate systems. If, after coating and adding a third adhesive and separating strip, the two strips are pressed together, there is obtained a paper-type effervescent tablet, wherein the reactive partners are separated by a thin adhesive strip of paper and are thus stable also under normal climactic conditions. This variant of the principle allows a further application of denture-cleaning agents, which was not possible until the present time.

If the paper strip is made approximately in the size of 9×12 cm, substantially lower concentrations are obtained on the paper, so that it is still flexible and elastic. If a denture is moistened with water and wrapped in such paper, the moisture present on the denture begins to wet the effervescent system together with the detergent substances; a dense foam is immediately formed on the denture, the concentration of the cleaning substances on the denture being approximately 1:100 in comparison with the conventional systems which require a bath. Moreover, the denture can still be rubbed mechanically with the paper in strongly soiled areas, so that it can be completely cleaned in 30–60 seconds. After the cleaning, the paper is thrown away, the denture is rinsed and reinserted.

Of course, a paper thus coated can be manufactured also in the form of an envelope closed on three sides. The wet denture is then inserted into the envelope, so that both in this case and also in the preceding one a water cup need not be used and the denture can be cleaned discretely in the shortest possible time at any water faucet.

The invention is explained more in detail through the following examples, wherein the parts indicated refer to parts by weight.

EXAMPLE 1

(a) 30 parts water, 100 parts citric acid and 5 parts of alginic acid propyl ester are stirred together, whereafter the pasty material is mixed with 5 parts sodium lauryl sulfate and 10 parts micronized silicic acid and ground on a colloid mill to a size below 5μ. The cycled mixture is led through a drawing machine under which a support consisting of absorbent paper, which is to be coated, is passed.

(b) 30 parts water, 100 parts sodium bicarbonate and 5 parts alginic acid propyl ester are mixed together, combined with 10–30 parts sodium polyphosphate, 5 parts sodium lauryl sulfate and, possibly, a dye and then ground on the colloid mill to a size less than 5μ. This component mixture is applied with the drawing machine to the support in strips separated from the mixture (a).

The cleaning material thus produced is suitable especially for houshold purposes, but also for cleaning windshields.

EXAMPLE 2

(a) 30 parts water, 100 parts potassium monopersulfate and 5 parts carbomethyl cellulose are mixed together, along with detergent. The mixture may possibly be colored with chemically inert earth colors.

(b) 30 parts water, 50 parts sodium polyphosphate, 50 parts sodium perborate and 5 parts colloidal carboxylvinyl polymer are ground to 5μ.

Mixtures of components (a) and (b) are applied to a support, just as in Example 1.

EXAMPLE 3

30 parts methylene chloride, 50 parts chloroform and 30 parts polyvinyl pyrrolidone are mixed together along with detergent and the resulting solution is combined with 400 parts anhydrous sodium hydrogen sulfate and ground to 5μ in a colloid mill. The dry material is sprayed as a coating together with a fine powder of calcium hydride by means of a powder-dispensing device. After the passage through an infrared heater, the moisture-sensitive hydride adheres to the moisture-absorbing layer of sodium hydrogen sulfate and polyvinyl pyrrolidone.

This detergent is used for impregnating a support consisting of absorbent paper or cloth.

EXAMPLE 4

50 parts methylene chloride, 50 parts methyl alcohol, 20 parts polyvinyl pyrrolidone, 200 parts anhydrous sodium carbonate, 50 parts fumaric acid, 150 parts monosodium citrate and 50 parts micronized silicic acid together with detergent are ground to 5μ. A support consisting of absorbent paper or cloth is impregnated with this detergent and dried.

EXAMPLE 5

An acid component (a) and an alkaline component (b) are produced in the manner described in Example 1. Each component is applied to a support consisting of absorbent paper, so that two separate supports are obtained, one containing the acid component and the other containing the alkaline component. A central joining layer is produced in a separate operation by impregnating or bilaterally coating a paper with a solution of polyethylene glycol (Carbowax). The supports carrying components (a) and (b) are placed on each of the sides of the separation sheet thus obtained and joined into a unit with such sheet through a simple passage between heated rollers.

EXAMPLE 6

A paper band is coated with the following solution on a special drawing machine:

(a) 60 parts potassium monopersulfate
20 parts citric acid
10 parts polyvinyl pyrrolidone
5 parts sodium lauryl sulfate
5 parts cetyl ammonium bromide The suspension is effected in a double to triple amount of a mixture consisting of equal parts methanol and methylene chloride.

Of course, when using an industrial infrared drying line, which heats the paper web to 100°, it is naturally also possible to use water.

(b) 70 parts anhydrous sodium carbonate
20 parts sodium pyrophosphate
5 parts polyvinyl pyrrolidone
3 parts sodium lauryl sulfate
2 parts cetyl ammonium bromide The suspension is effected as under (a) (methylene chloride—methanol or water).

By means of a drawing machine, a support is coated with suspensions (a) and (b) separately in separate areas; then the support is dried. This cleaning material is suitable in particular for the care of dentures. If two separate supports are provided in each case with one of the suspensions and combined into a unit by means of a separation layer, the unit can be cut into "tablets," that can be used for the cleaning of dentures just as ordinary tablets, in which connection the paper that remains can possibly be used for removing the deposits still adhering to the denture.

EXAMPLE 7

Manufacture of a Bath Sponge

A foamed material having a thickness of, e.g., 10 mm is led from the roll under a spraying device, which sprays the following suspensions:

10 parts sodium lauryl sulfate
2 parts diethyl amide of coconut (oil) acid
10 parts polyethylene glycol 4000
78 parts sodium bicarbonate Onto a second roll of foamed material, preferably possessing a different color, there is sprayed the gas-releasing mixture. It consists of:

10 parts sodium lauryl sulfate
2 parts diethyl amide of coconut (oil) acid
10 parts polyethylene glycol 4000
78 parts tartaric acid The amount of water required for spraying or coating the two mixtures varies between 50 and 200% of the amount indicated. A paper support containing a scent component is placed between the two supports of foamed material. The paper support is preferably impregnated with a solution of, e.g., 80 parts pine needle oil and
20 parts dwarf pine oil About 2 mg per $cm^2$ are sufficient in this connection.

The third paper support is led between the two coated surfaces of the support consisting of foamed material and welded by means of a hot sealing roller. The amounts of Carbowax 4000 present in the mixtures effect a reciprocal adhesion of the three layers. Of course, in order to intensify the adhesion, the central strip can be impregnated with additional amounts of Carbowax, in which connection one additionally obtains a better separation of the reactive layers and the essential oils are protected against saponification.

It will be obvious to those skilled in the art that various changes may be made without departure from the scope of the invention and the invention is not to be considered limited to what is described in the specification.

What is claimed is:

1. A process of manufacturing a cleaning element comprising producing a first solution or suspension from a first mixture of components comprising at least one substance capable of forming a gas selected from the group consisting of calcium hydride, an oxygen generating substance and a $CO_2$-generating substance; and a water-soluble adhesive;

producing a second solution or suspension from a second mixture of components comprising at least one substance triggering the formation of gas, and a water-soluble adhesive;

adding to either said first or second mixtures or both of said mixtures a detergent selected from the group consisting of anionic, cationic and nonionogenic surfactants;

impregnating or coating a porous, flexible support consisting of paper, fabric or sponge with said first solution or suspension in at least one first area of said support, and drying the so-impregnated support; and impregnating or coating said porous, flexible support in at least one second area of said support separate from said first area, with said second solution or suspension, and drying the so-impregnated support.

2. A process as in claim 1, wherein the solution or suspension of the first mixture of components and the solution or suspension of the second mixture of components are applied separated from each other on the support in the form of adjacent strips, spots or surfaces.

3. A process as in claim 1, wherein said support is impregnated on opposite sides to a depth of penetration which avoids a reciprocal contact of the mixture of components.

4. A process as in claim 1, wherein a first support is coated or impregnated with the solution or suspension of the first mixture of components and a second support is coated or impregnated with the solution or suspension of the second mixture of components, and said first and second supports are dried and are then glue-bonded at faces by means of a separating joining layer.

5. A process as in claim 1, wherein a peroxo compound is employed as the substance capable of generating oxygen.

6. A process as in claim 1, wherein a carbonate or bicarbonate is employed as the substance capable of forming gas.

7. A process as in claim 5, wherein an alkali is employed as the substance triggering the formation of gas.

8. A process as in claim 6, wherein an acid or a salt exhibiting acid reaction in aqueous solution is employed as the substance triggering the formation of gas.

9. A process of manufacturing a cleaning material comprising producing a solution or suspension from a detergent selected from the group consisting of anionic, cationic or nonionogenic surfactants, a water-soluble adhesive, and at least one substance capable of forming gas consisting of calcium hydride in a non-polar solvent impregnating or coating a porous, flexible support consisting of paper, fabric or sponge with said solution or suspension; and drying the so-impregnated support.

* * * * *